US008642904B2

(12) United States Patent
Chiba et al.

(10) Patent No.: US 8,642,904 B2
(45) Date of Patent: Feb. 4, 2014

(54) LINK STRUCTURE AND KEY SWITCH STRUCTURE

(75) Inventors: Toshimi Chiba, Gunma (JP); Hiromi Ebisawa, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 78 days.

(21) Appl. No.: 13/475,288

(22) Filed: May 18, 2012

(65) Prior Publication Data

US 2012/0292168 A1 Nov. 22, 2012

(30) Foreign Application Priority Data

May 20, 2011 (JP) ..... 2011-113583

(51) Int. Cl.
*H01H 13/70* (2006.01)

(52) U.S. Cl.
USPC ..... 200/344; 200/5 A; 200/345

(58) Field of Classification Search
USPC ..... 200/341, 343–345, 520, 534
See application file for complete search history.

(56) References Cited

U.S. PATENT DOCUMENTS

| | | | | |
|---|---|---|---|---|
| 5,898,145 | A * | 4/1999 | Su | 200/344 |
| 7,385,149 | B2 * | 6/2008 | Liu | 200/5 A |
| 7,893,376 | B2 * | 2/2011 | Chen | 200/344 |
| 8,080,755 | B2 * | 12/2011 | Cheng | 200/344 |
| 8,164,017 | B2 * | 4/2012 | Cheng | 200/344 |

FOREIGN PATENT DOCUMENTS

JP 2001-229764 A 8/2001

* cited by examiner

*Primary Examiner* — Kyung Lee
(74) *Attorney, Agent, or Firm* — Rabin & Berdo, P.C.

(57) ABSTRACT

A link structure can include an outside link member and an inside link member. Shaft holes can be formed in respective inner lateral sides of the outside link member and face each other across a first opening portion. First stopper members can be arranged on the respective inner lateral sides, and each have a first inclined face and a first stopper surface. The outside link member can be elastically deformable based on a pressure applied to the first inclined surfaces that increases a distance between the shaft holes. The inside link member can include a second opening portion, link rotational shafts that are disposed in the shaft holes, and second stopper members each having a second inclined surface and a second stopper surface. The inside link member can be elastically deformable based on a pressure applied to the second inclined surfaces that decreases a distance between the link rotational shafts.

4 Claims, 14 Drawing Sheets

LINK STRUCTURE AND KEY SWITCH STRUCTURE

CROSS-REFERENCE TO RELATED APPLICATION

This application claims priority under 35 U.S.C. §119 from Japanese Patent Application NO. P 2011-113583, filed on May 20, 2011, the disclosure of which is incorporated herein by reference.

BACKGROUND

1. Technical Field

This application relates to a link structure and a key switch structure used for a keyboard of an apparatus, such as an information processing apparatus, a measuring apparatus, a medical apparatus, or a personal computer.

2. Description of the Related Art

Keyboards in apparatuses as described above conventionally include link structures. The link structures may include rotating members that present difficulties in assembling the keyboards.

SUMMARY

This application discloses aspects of a link structure and a key switch structure which assembly workers may assemble easily.

According to one aspect, a link structure can include an outside link member, and an inside link member. The outside link member can include a first opening portion. The first opening portion can have inner lateral sides, wherein shaft holes are formed in respective ones of the inner lateral sides and face each other across the first opening portion.

First stopper members can be arranged on the respective ones of the inner lateral sides, facing each other across the first opening portion. Each first stopper member can have a side with a first inclined surface inclining toward the first opening portion, and thinning down the first stopper member toward the first opening portion. Each first stopper member can further have a first stopper surface on another side of the first stopper member.

The outside link member can be elastically deformable based on a pressure applied to the first inclined surfaces that increases a distance between the shaft holes and between the first stopper members.

The link structure can further comprise an inside link member. The inside link member can include a second opening portion having outer lateral sides, and link rotational shafts disposed in the shaft holes. The link rotational shafts can be arranged on respective ones of the outer lateral sides of the inside link member, and opposite each other across the second opening portion. The inside link member can further include second stopper members, each second stopper member having a side with a second inclined surface inclining toward an outside of the inside link member, and thinning down the second stopper member toward an outside of the inside link member, and a second stopper surface on another side of the second stopper member. The second stopper members can be arranged on the respective ones of the outer lateral side and opposite each other across the second opening portion.

The inside link member can be elastically deformable based on a pressure applied to the second inclined surfaces that decreases a distance between the second inclined surfaces and between the link rotational shafts. The inside and outside link members can be able to rotate with respect to or against each other, and the first and second stopper surfaces can face each other.

According to another aspect, a link structure can include an outside link member, and an inside link member. The outside link member can include a first opening portion having inner lateral sides. Link rotational shafts can be arranged on respective ones of the inner lateral sides, facing each other across the first opening portion.

The outside link member can further include first stopper members arranged on the respective ones of the inner lateral sides and facing each other across the first opening portion. Each first stopper member can have a side with a first inclined surface inclining toward the first opening portion, and thinning down the first stopper member toward the first opening portion. Each first stopper member can further include a first stopper surface on another side of the first stopper member.

The outside link member can be elastically deformable based on a pressure applied to the first inclined surfaces that increases a distance between the link rotational shafts and between the first stopper members.

The inside link member can include a second opening portion having outer lateral sides, wherein shaft holes are formed in respective ones of the outer lateral sides, and the link rotational shafts are disposed in the shaft holes.

The inside link member can further include second stopper members, each second stopper member having a side with a second inclined surface inclining toward an outside of the inside link member and thinning down the second stopper member toward the outside of the inside link member. Each second stopper member can further include a second stopper surface on another side of the second stopper member. The second stopper members can be arranged on the respective ones of the outer lateral sides and opposite each other across the second opening portion.

The inside link member can be elastically deformable based on a pressure applied to the second inclined surfaces that decreases a distance between the second inclined surfaces and between the shaft holes. The inside and outside link members can be able to rotate with respect to or against each other, and the first and second stopper surfaces can face each other.

BRIEF DESCRIPTION OF THE DRAWINGS

The link structure and the key switch structure will be more fully understood from the following detailed description with reference to the accompanying drawings, which is given by way of illustration only, and is not intended to limit.

DETAILED DESCRIPTION

First Embodiment

Figure 1:
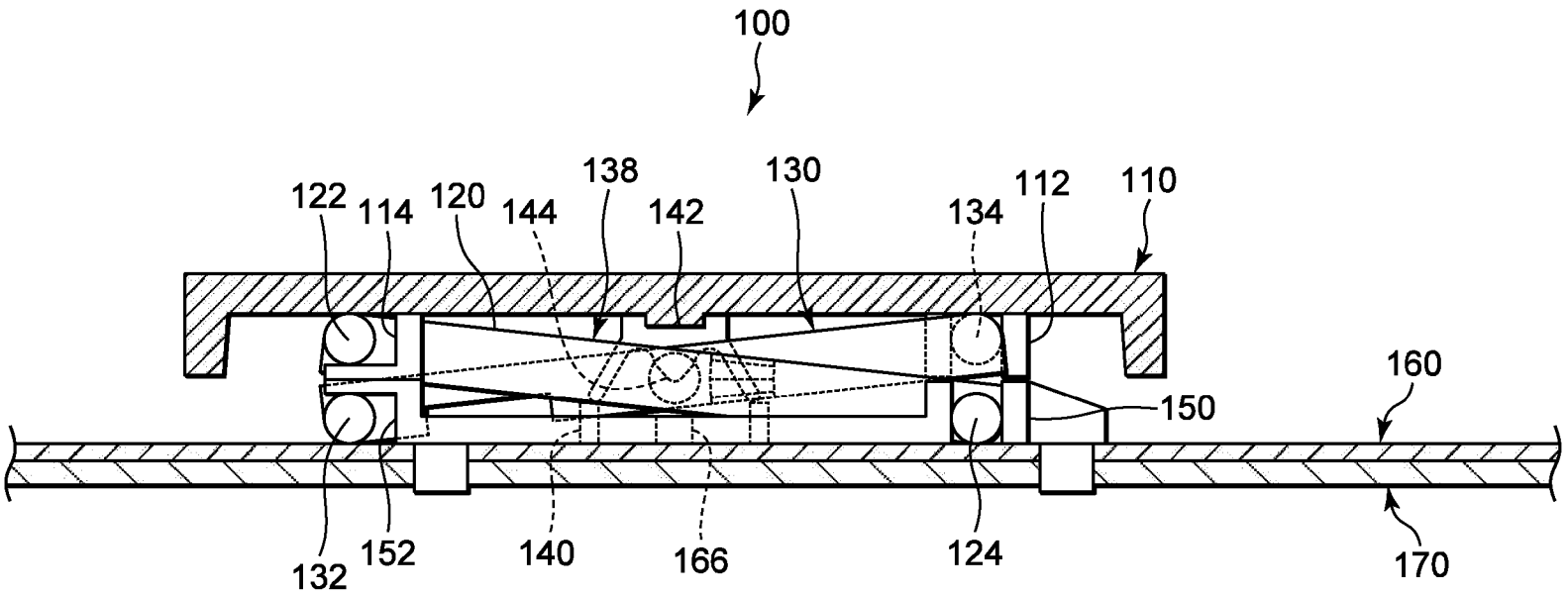
FIG. 1 is a cross-sectional view of the key switch structure according to a first embodiment.
Figure 2:
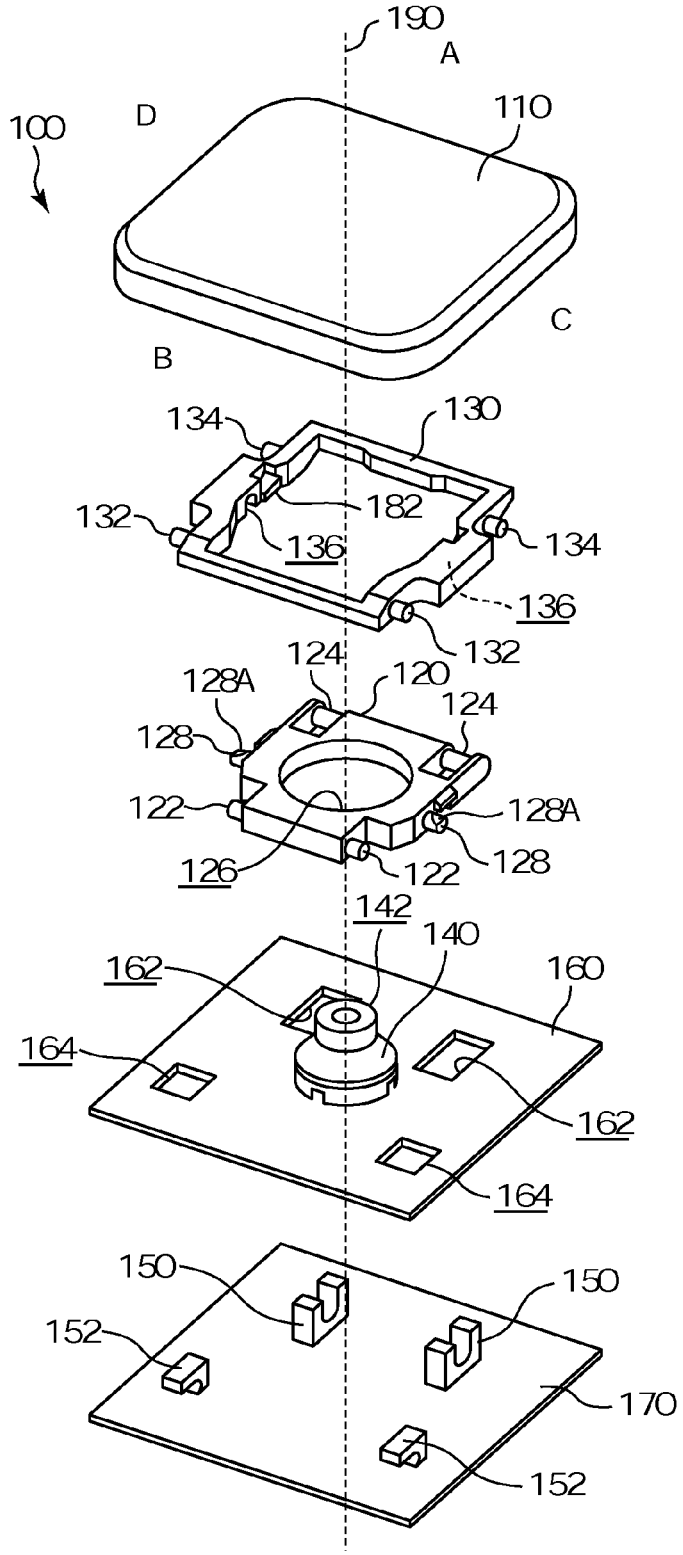
FIG. 2 is a first exploded perspective view of the key switch structure shown in FIG. 1.

FIG. 1 is a cross-sectional view of a key switch structure 100 according to a first embodiment. FIG. 2 is a first exploded perspective view of the key switch structure 100 shown in FIG. 1. In FIG. 2, there are four letters (A, B, C, and D) to support explanations of the embodiment. The letters A, B, C, and D represent respectively the right upper side, the left under side, the right under side, and the left under side of respective members shown in FIG. 2. Also, these letters will be used in FIGS. 3, 4, 5, 6, 11, 12, 13, and 14 as with FIG. 2.

Referring to FIGS. 1 and 2, the key switch structure 100 can include a key top 110, an inside link member 120, an outside link member 130, a dome 140 which can be or include an elastic, e.g., rubber, member, a membrane sheet 160, and a back plate 170. As shown in FIG. 2, only one section of the membrane sheet 160 and the back plate 170 corresponding to the key top 110 is illustrated. However, when the key top structure is actually used for a keyboard, the membrane sheet 160 and the back plate 170 can each be formed from a single part and can correspond to all of the key tops of the keyboard.

An assembly reference line 190 is centrally disposed with respect to the members shown in FIG. 2 for explanation of the embodiment. Also, in FIG. 3 and FIG. 4, the assembly reference line 190 is used as with FIG. 2 for explanation of the embodiment.

The back plate 170 can include two rotational support members 150 arranged on the surface of the A side thereof, and two slide support members 152 arranged on the surface of the B side thereof. The rotational support member 150 can include a bearing portion. The slide support member 152 can include a projection portion. Also, the back plate 170 can be formed from or include a material, such as a metal or a hard plastic, that has a predetermined hardness and stiffness.

The membrane sheet 160 can be formed by upper and under sheets (not illustrated) that are made of or include a soft material and that have a printed wiring pattern. Also, the membrane sheet 160 can include a spacer sheet (not illustrated) made of or including a soft material sandwiched between the upper and under sheets. The membrane sheet 160 can be attached to the surface of the back plate 170. Also, the membrane sheet 160 can include two holes 162 and two holes 164 so that the members 150 and 152 may penetrate through the membrane sheet 160.

A contacting portion 166 can be fixed on the center part of the membrane sheet 160 so that the center of the contacting portion 166 matches the assembly reference line 190. The dome 140 can be fixed on the membrane sheet 160 so as to cover the contact portion 166 on the assembly reference line 190. The dome 140 can be cup-shaped, and include a fitting hole 142 at the center upper side thereof. Also, the dome 140 can include a contact pressing member 144 disposed at the center part of the inside thereof that bulges toward the membrane sheet 160. The center top of the contact pressing member 144 can be disposed on the assembly reference line 190.

If an operator of the key board presses the key top 110, the key top 110 can be moved to the membrane sheet 160 while keeping parallel to the membrane sheet 160, by moving of a link structure 138 that will be described below. During movement of the key top 110 from a predetermined position toward the membrane sheet 160, the dome 140 can be pressed by the key top 110 and deform. Then the contact pressing member 144 can contact and press the contact portion 166.

The upper and under sheets of the membrane sheet 160 can respectively include an electrical contact portion. The electrical contact portions can face toward and against each other at the position corresponding to the contact portion 166. If the membrane sheet 160 is pressed in a perpendicular direction by the contact portion 166, the respective electrical contact portions can contact each other and connect electrically. Then, the circuit of the electrical contact portions that forms an electrical switch can enter or assume a closed condition.

If the operator releases the key top 110, and the key top 110 is released from pressing, the key top 100, the contact pressing member 144, and the contact portion 166 can return to respective original positions by a restoring force (e.g., an elastic force) of the dome 140 and the membrane sheet 160. As a result, the membrane sheet 160 can be released from the pressing of the contact portion 166, and the electrical connection between the electrical contacts of the upper and under sheets can be released. Then, the circuit of the electrical contacts that form the electrical switch can enter or assume an opened condition.

Figure 3:
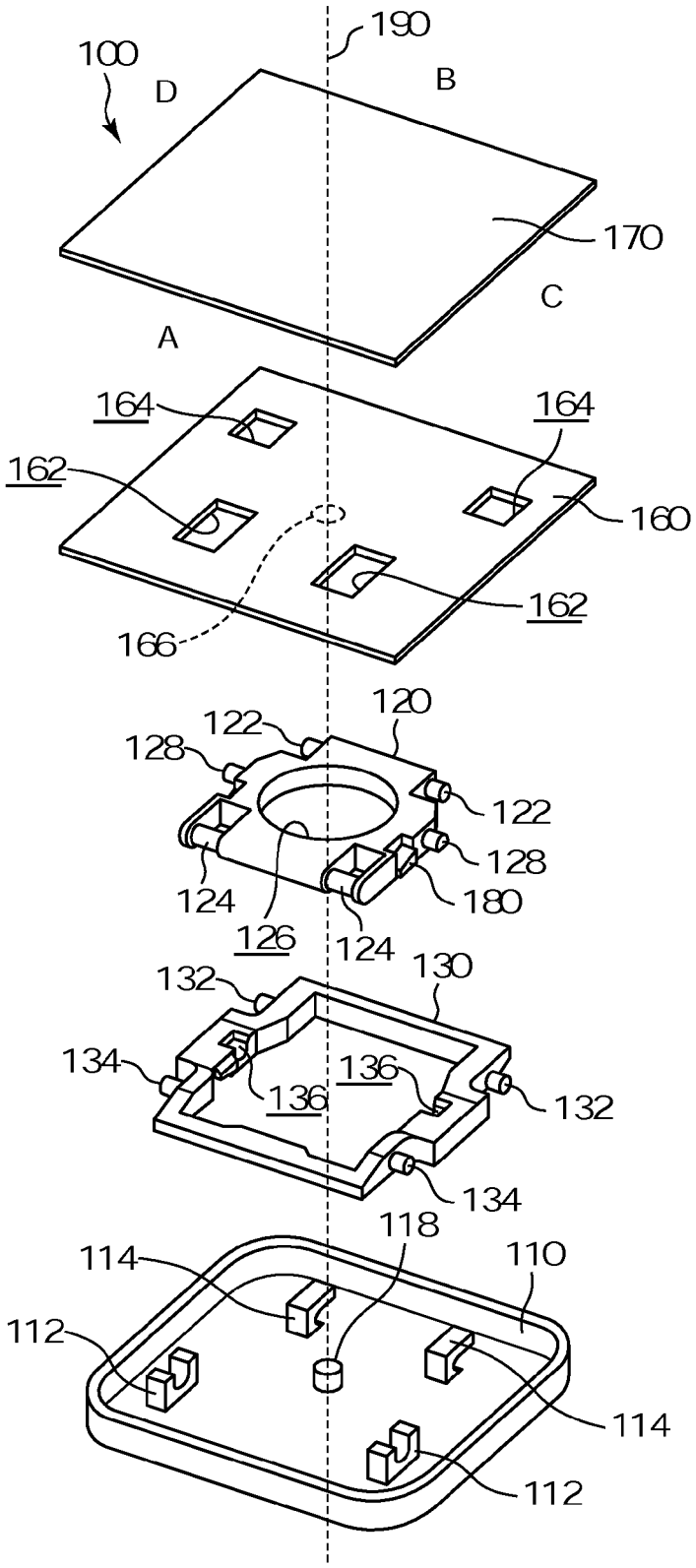
FIG. 3 is an exploded perspective view key switch structure shown FIG. 1 rotated 180 degrees.

FIG. 3 is an exploded perspective view of the key switch structure 100, rotated 180 degrees (e.g., reversed and upside down) with respect to the view of FIG. 1. The key top 110 can include two rotational support members 112 arranged on the back side of the A side of the key top 110. Each rotational support member can include a bearing portion. Also, the key top 110 can include two slide support members 114 arranged on the back side of the B side of the key top 110. Each slide support member can include a projection portion. Also, the key top 110 can include a projection portion 118 arranged the center portion thereof that is inserted into the fitting hole 142 after assembling the key switch structure 100.

Figure 5:
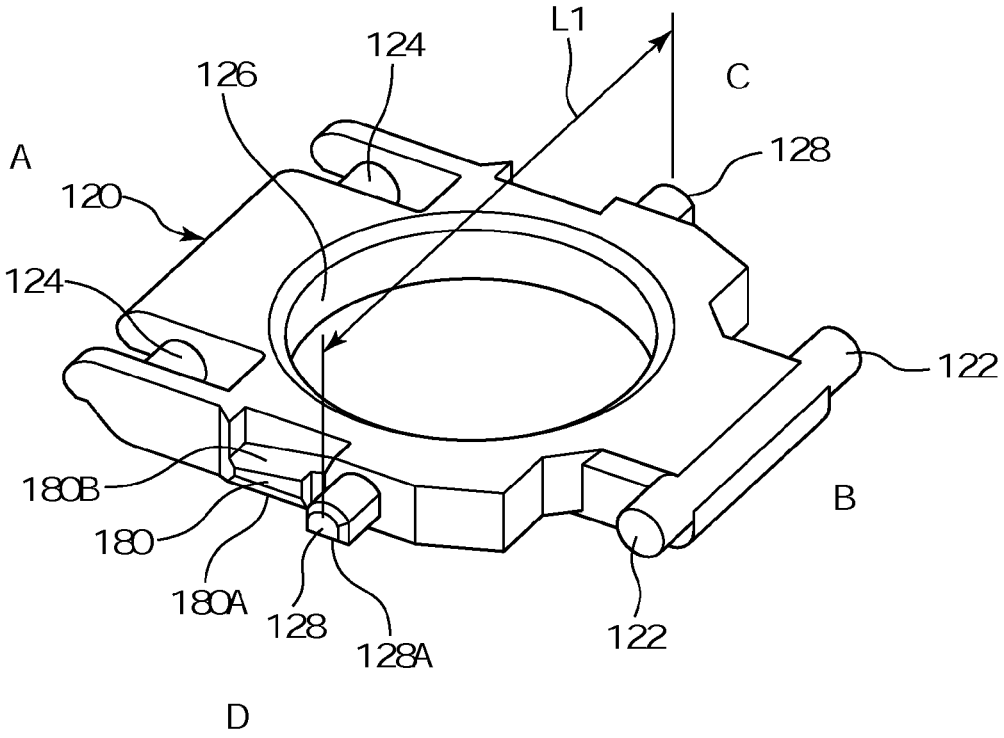
FIG. 5 is a perspective view of an inside link member according to the first embodiment.

FIG. 5 is a perspective view of the inside link member 120 according to the first embodiment. The inside link member 120 can be frame-shaped and have an opening portion 126 at substantially the center thereof. Also, the inside link member 120 can include two link rotational shafts 128 on the respective outer lateral sides of the C and D sides thereof. The link rotational shaft 128 can include an inclined surface 128A disposed at the top edge thereof so as to thin down the link rotational shaft 128 toward the outside of the inside link member 120, and the inclined surface 128A can have a predetermined angle relative to the rotational axis of the link rotational shaft 128.

Additionally, the edge of the top of the link rotational shaft 128 can be chamfered. Also, the inside link member 120 can include two slide shafts 122 disposed at the respective outer lateral sides of the C and D sides thereof. Also, the inside link member 120 can include two rotational shafts 124 disposed at the outer lateral side of the A side thereof. After the key switch is assembled, the slide shafts 122 can be supported so as to be able to rotate and slide in the projection portion of the slide support members 114, and the rotational shafts 124 can be supported so as to be able to rotate in the bearing of the rotational support members 112.

Also, the inside link member 120 can include two stopper members 180 at the respective adjacent outer lateral sides of the link rotational shafts 128. The stopper member 180 can include an inclined surface 180A that faces toward the under side in FIG. 5. After the key top structure 100 is assembled, the inclined surfaces 180A can face toward the key top 110. Also, the stopper member 180 can include a stopper surface 180B that faces toward the upper side in FIG. 5. After the key top structure 100 is assembled, the stopper surfaces 180B can face toward the back plate 170.

Figure 6:
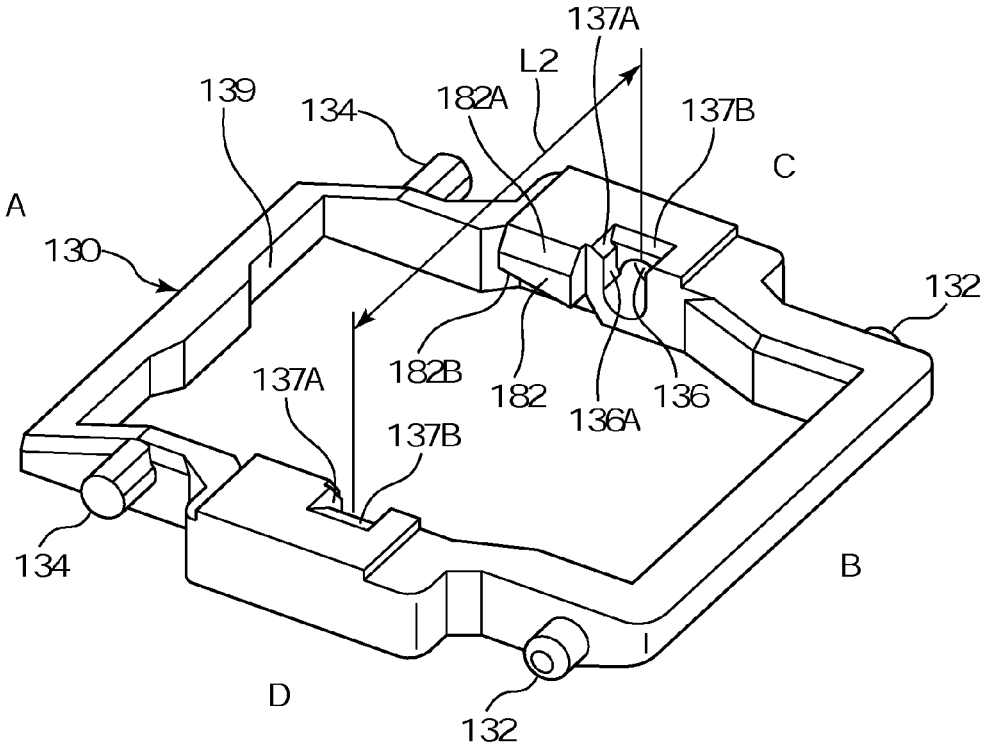
FIG. 6 is a perspective view of an outside link member according to the first embodiment.

FIG. 6 is a perspective view of the outside link member according to the first embodiment. The first link member 130 can be frame-shaped and include an opening portion 139 disposed at substantially the center thereof into which the inside member 120 can be inserted. Also, the outside link member 130 can include two slide shafts 132 disposed respectively on ends of outer lateral sides of the C and D sides of the outside link member 130. Also, the outside link member 130 can include two rotational shafts 134 disposed respectively on the other ends of the outer lateral sides of the outside link member 130. After the key switch is assembled, the slide shafts 132 can be supported so as to be able to rotate and slide in the projection portion of the slide support member 152. The rotational shafts 134 can be supported so as to be able to rotate in the bearing of the rotational support members 150.

Also, the outside link member 130 can have two shaft holes 136 formed in the respective inner lateral sides of the C and D sides thereof. As shown in FIG. 6, a surface defining a shaft hole 136 can have formed therein an inserting groove 136A at the upper side of the entrance to the shaft hole 136. The opening width of the inserting groove 136A can be equal to or more than the diameter of the shaft hole 136. Also, the shaft hole 136 can include chamfered portions, e.g., two chamfered portions 137A and 137B at the edge of the inserting groove 136A.

Also, the outside link member 130 can include two stopper members 182 that are projection portions adjacent to respective shaft holes 136. The stopper member 182 can be arranged at the upper side as shown in FIG. 6. The stopper member 182 can include an inclined surface 182A that inclines so as to thin down the stopper member 182 toward the opening portion 139. After the key switch structure 100 is assembled, the inclined surfaces 182A can face toward the back plate 170. Also, the stopper member 182 can include a stopper surface 182B that faces toward the under side as shown in FIG. 6. After the key switch structure 100 is assembled, the stopper surfaces 182B can face toward the key top 110.

Figure 4:
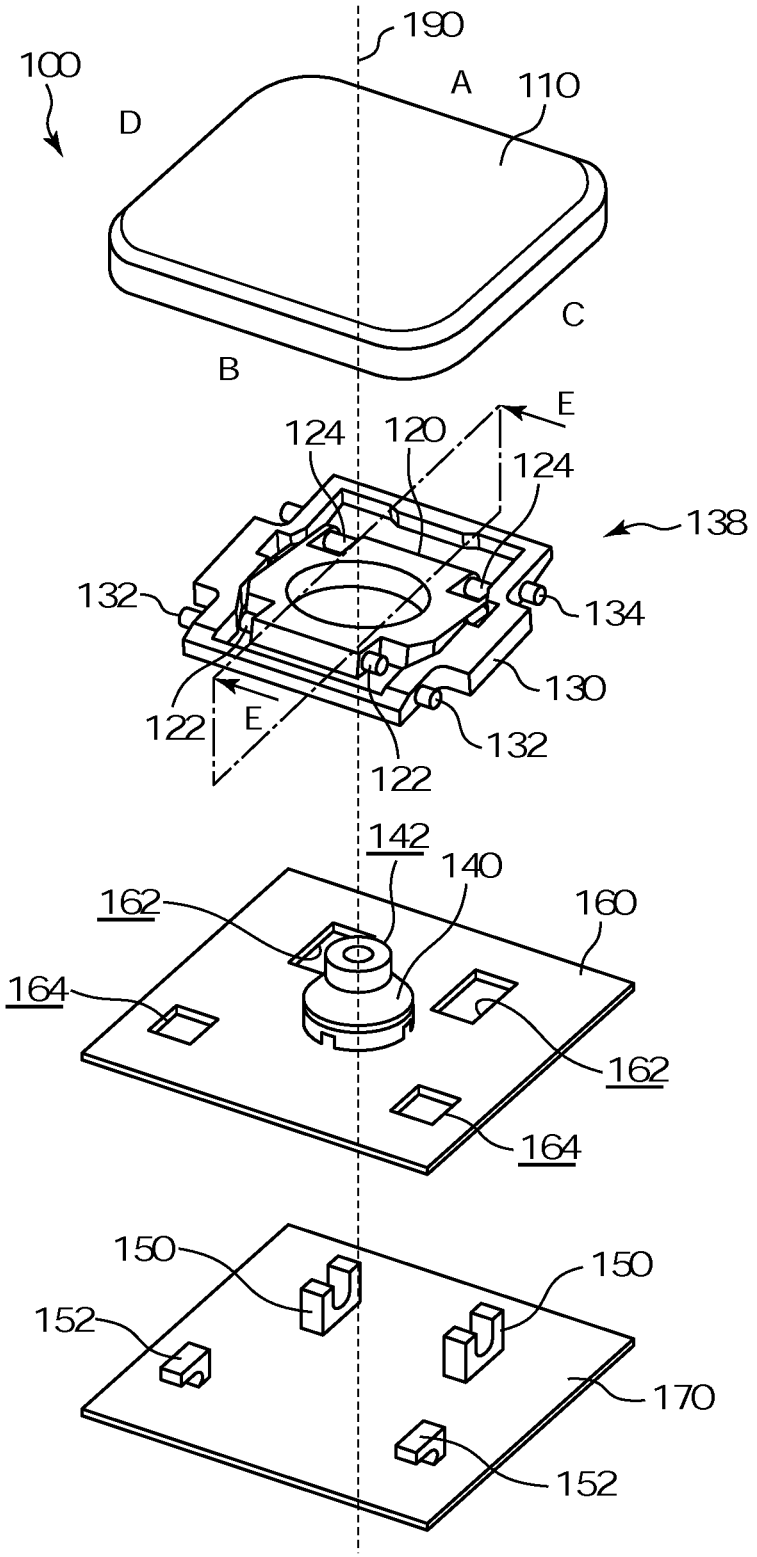
FIG. 4 is a second exploded perspective view of the key switch structure shown in FIG. 1.

FIG. 4 is a second exploded perspective view of the key switch structure shown in FIG. 1. As shown in FIG. 4, the inside link member 120 can be fitted into the outside link member 130. Also, the link structure 138 can be formed by the inside and outside link members 120 and 130.

Figure 7A:
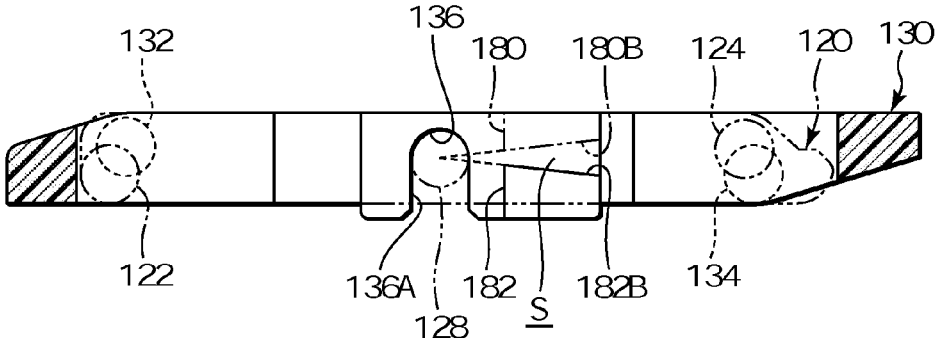
FIG. 7A is a cross-sectional view illustrating a link structure along a plane E-E in FIG. 4 while a key top is in a pressed position.
Figure 7B:
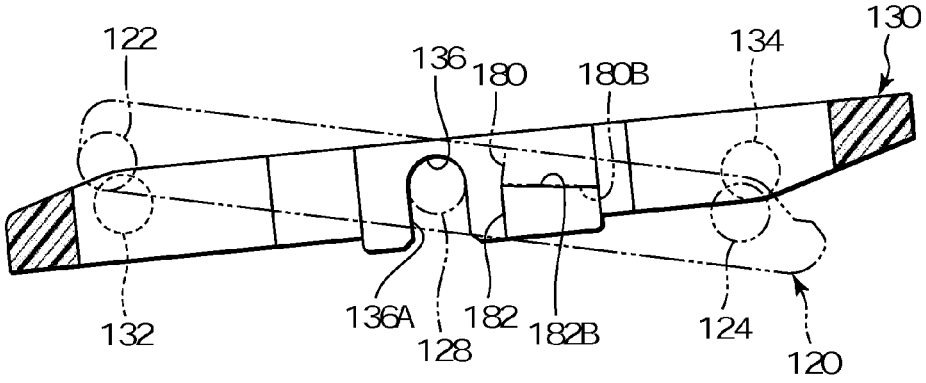
FIG. 7B is a cross-sectional view illustrating the link structure along a plane E-E in FIG. 4 while the key top is in a normal (e.g., unpressed or non-pressed) position.

FIGS. 7A and 7B are cross-sectional views illustrating the link structure 138 along a plane E-E in FIG. 4, e.g., including a view of the key top in a pressed position. Here, the inside link member 120 is illustrated by only a broken line to explain a state of the link structure 138. FIGS. 9A-9E are cross-sectional views along the rotational axes of the outside and inside link members 120 and 130, which illustrate an assembly procedure according to the first embodiment. As shown in FIGS. 1, 4, 7A, 7B and 9A-9E, if the key top 100 is assembled, the inside link member 120 can be inserted into the outside link member 130 so that the link rotational shafts 128 are inserted into the shaft holes 136.

After assembly, the link rotational shaft 128 and the shaft hole 136 may rotate against each other by the link rotational shaft 128 serving as the rotational axis. If the key top 110 is pressed by the operator, the rotational shaft 134 may keep a present position against the key top 110, and may rotate on the spot (e.g., in place), because the rotational shaft 124 is supported by the rotational support member 112 so as to be able to rotate in the bearing of the rotational support member 112. Also, the rotational shaft 134 may keep a present position against the back plate 170, and may rotate on the spot (e.g., in place), because the rotational shaft 134 is supported by the rotational support member 150 so as to be able to rotate in the bearing of the rotational support member 150. Also, the slide shafts 122 may rotate and slide in the projection portion of the slide support member 114. Also, the slide shafts 132 may rotate and slide in the projection portion of the slide support member 152.

Figure 9A:
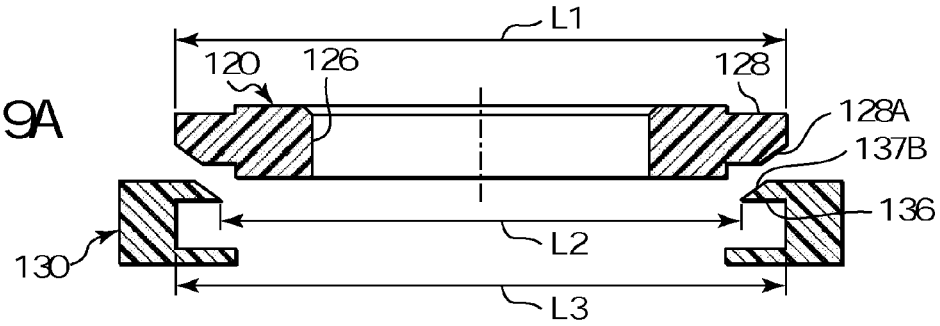
FIG. 9A is a first cross-sectional view along the rotational axes of the outside and inside link members, which further illustrates the assembly procedure according to the first embodiment.
Figure 9B:
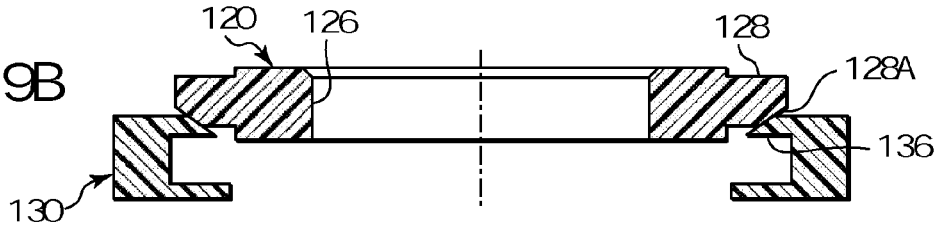
FIG. 9B is a second cross-sectional view along the rotational axes, which further illustrates the assembly procedure according to the first embodiment.
Figure 9C:
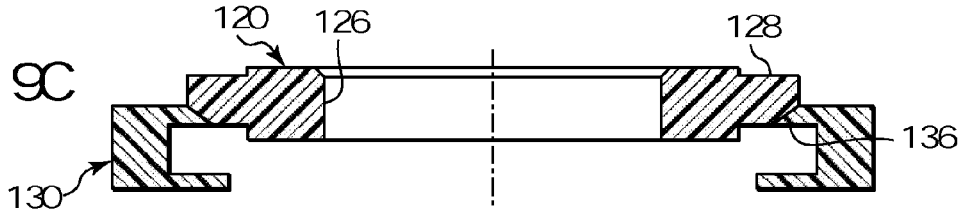
FIG. 9C is a third cross-sectional view along the rotational axes, which further illustrates the assembly procedure according to the first embodiment.

Next, a connecting structure of the inside link member 120 and the outside link member 130 will be described. FIG. 9A is a cross-sectional view along the rotational axes of the inside and outside link members 120 and 130, which illustrates an assembly procedure according to the first embodiment. As shown in FIGS. 3, 6, and 9A-9E, the outside link member 130 can have the two shaft holes 136 formed in the respective inner lateral sides thereof. The shaft hole 136 can have a predetermined diameter so that the link rotational shaft 128 may be inserted into the shaft hole 136 and rotated easily.

A distance L1 can be the distance from one edge of the link rotational shaft 120 to the other edge thereof. A distance L2 can be the longest distance between one entrance of the shaft hole 136 and the other entrance thereof. A distance L3 can be the longest distance between one shaft hole 136 and the other shaft hole 136 (e.g., a distance between farthest ends of the shaft holes 136). As shown in FIG. 9A, the distance L1 can be longer than the distance L2, and the distance L1 can be equal to or a little shorter than the distance L3.

Therefore, if the link rotational shafts 128 are inserted into the shaft holes 136, the inside and outside link members 120 and 130 may rotate on the link rotational shafts 128 as the rotational axis. Also, as shown in FIG. 9E, since the distance L1 can be longer than the distance L2, it is possible to prevent the link rotational shaft 128 from dropping out of the shaft hole 136 after assembly.

As shown in FIG. 7A, when the inside link member 120 is inserted into the outside link member 130 and is parallel to the first link member 130 (e.g., in the condition of lying on the same, or approximately or substantially the same, level), the stopper member 180 can be disposed at the upper side as shown in FIG. 7A. Also, the stopper member 182 can be disposed at the under side in FIG. 7A.

The stopper surface 180B and the stopper surface 182B can face toward and against each other with a clearance gap S. The distance of the clearance gap S from the stopper surface 180B to the stopper surface 182B can increase gradually as the distance from the link rotational shaft 128 increases. Thus, the stopper surface 180B and the stopper surface 182B can be respectively inclined.

As shown in FIG. 7A, an extended line of the stopper surface 180B can cross an extended line of the stopper surface 182B on the rotational axis of the link rotational shaft 128. Therefore, as shown in FIG. 7B, if the second link member 120 and the first link member 130 rotate on the link rotational shaft 128 so as to assume a shape resembling the letter X, the stopper surface 180B can contact the stopper surface 182B. Also, the stopper surfaces 180B and 182B can restrict the rotation of the inside and outside link members 120 and 130, e.g., the upper limit of a crossing angle of the inside and outside link members 120 and 130 can be decided by the stopper surfaces 180B and 182B.

Next, an assembly process of the link structure 138 will be described.

Figure 8A:
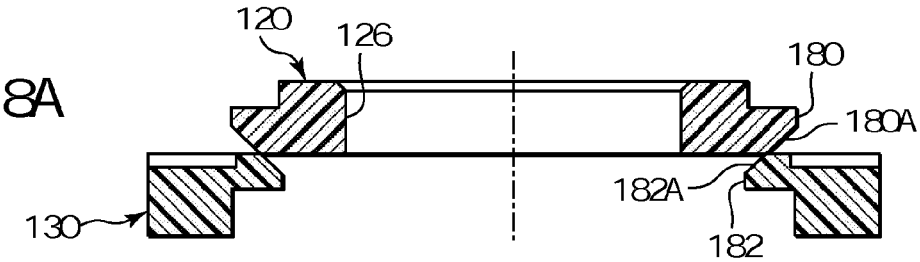
FIG. 8A is a first cross-sectional view along a line that connects between respective stopper members of the outside link member, which illustrates an assembly procedure according to the first embodiment.
Figure 8B:
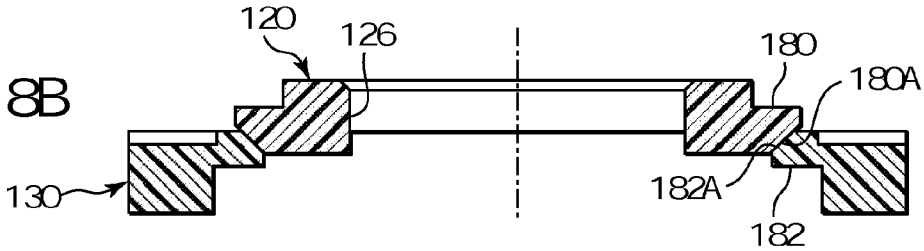
FIG. 8B is a second cross-sectional view along the line, which further illustrates the assembly procedure according to the first embodiment.
Figure 8C:
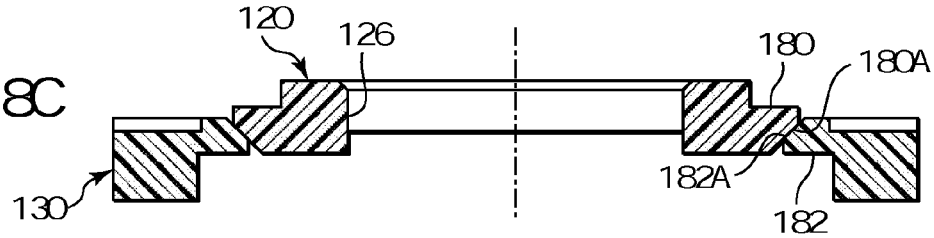
FIG. 8C is a third cross-sectional view along the line, which further illustrates the assembly procedure according to the first embodiment.

FIGS. 8A-8E are cross-sectional views of the inside and outside link members 120 and 130, which illustrates an assembly procedure according to the first embodiment. As shown in FIG. 8A, and FIG. 9A, first, the outside link member 130 can be placed horizontally on a working table of assembly workers so that the inserting groove 136A faces toward the upper side. Then the inside link member 120 can be placed horizontally upon the outside link member 130 so that the stopper member 180 faces toward the working table. The inside link member 120 can be placed upon the outside link member 130 so that the central axis of each of the shaft holes 136 is parallel to the rotational axis of the link rotational shaft 128 and, e.g., perpendicular to a vertical line that is perpendicular to a surface of the working table. The center line of the A to B direction (see, e.g., FIGS. 2 and 4) of the inside link member 120 can be parallel to the center line of the A to B direction of the outside link member 130, and the vertical line perpendicular to the surface of the working table.

The inside link member 120 can be pressed toward the outside link member 130 while keeping the inclined surface 182A parallel to and facing toward the second inclined surface 180A.

As shown in FIGS. 8B, 8C, 9B and 9C, while the inside link member 120 is pressed toward the outside link member 130, the inclined surface 180A can contact the inclined surface 182A toward the outside of the outside link member 130, and the inside link member 120 can be pushed into the outside link member 130 with elastic deformation of the link members 120 and 130. While the inclined surface 180A contacts the inclined surface 182A, the inclined surface 180A can slide or otherwise move toward the inside of the inside link member 120 (e.g., be elastically deformed inwardly), and the inclined surface 182A can slide or otherwise move toward the outside of the outside link member 130 (e.g., be elastically deformed outwardly).

Stated otherwise, the inside link member 120 can be pressed toward the inside thereof so as to decrease the distance L1, and the outside link member 130 can be pressed toward the outside thereof so as to increase the distances L2 and L3. Here, the elastic deformation can occur in the horizontal direction by the link members 120 and 130 pressing toward and sliding against each other.

Figure 8D:
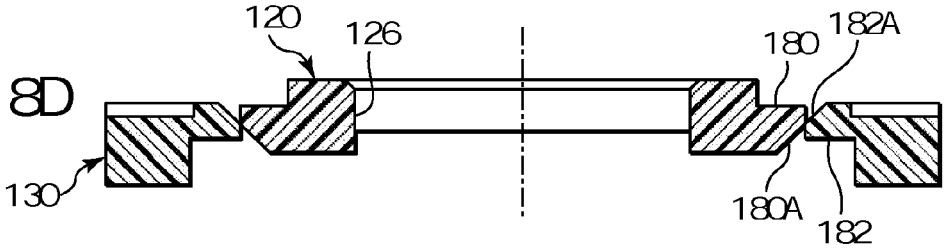
FIG. 8D is a fourth cross-sectional view along the line, which further illustrates the assembly procedure according to the first embodiment.
Figure 9D:
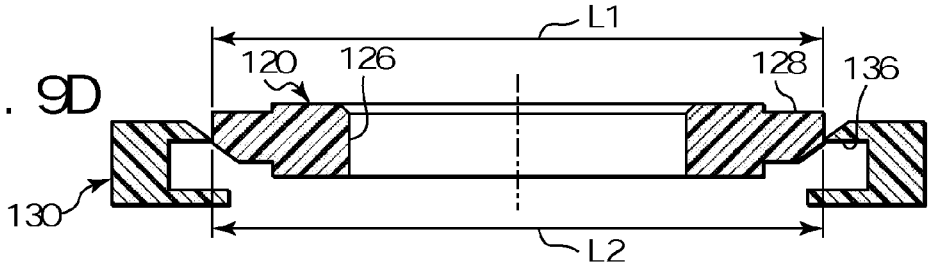
FIG. 9D is a fourth cross-sectional view along the rotational axes, which further illustrates the assembly procedure according to the first embodiment.
Figure 9E:
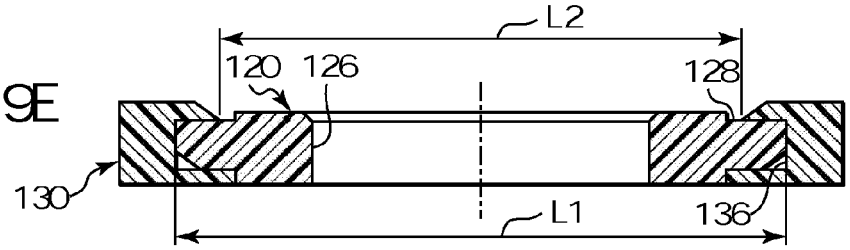
FIG. 9E is a fifth cross-sectional view along the rotational axes, which further illustrates the assembly procedure according to the first embodiment.

Next, as shown in FIGS. 8D and 9D, while the stopper member 180 passes through (e.g., moves past) the stopper member 182, and the link rotational shaft 128 passes through (e.g., moves past) the chamfered portion 137B, the distance L1 can be increased so as to be equal to or more than the distance L2.

Figure 8E:
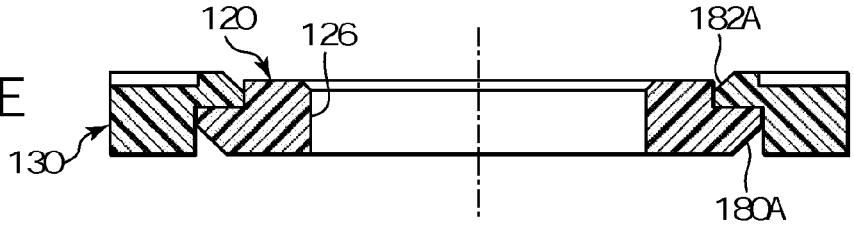
FIG. 8E is a fifth cross-sectional view along the line, which further illustrates the assembly procedure according to the first embodiment.

Next, as shown in FIGS. 8E and 9E, after the stopper member 180 and the link rotational shaft 128 have passed through (e.g., moved past) the stopper member 182 and the chamfered portion 137B, respectively, the link rotational shaft 128 can be inserted into the shaft hole 136, and the first link member 130 and the second link member 120 can return to their original (e.g., no longer elastically deformed) shape.

According to the link structure 138 of the first embodiment, the inside link member 120 and the outside link member 130 can be arranged so that the inclined surface 182A faces toward the inclined surface 180A before the inside link member 120 is inserted into the outside link member 130. Then, the inside link member 120 can be pushed into the outside link member 130, and the inclined surface 182A can contact the inclined surface 180A, while sliding with respect to the inclined surface 180A, so that the link members 120 and 130 are deformed with elasticity during the pushing. As a result, it is possible to insert the link rotational shaft 128 into the shaft hole 136 easily without unreasonable force being applied or added to the link rotational shaft 128, and to prevent deformation of the link rotational shafts 128 and the shaft holes 136 during the inserting thereof. Also, if the inserting of the link members 120 and 130 is finished, and the shapes of the link members 120 and 130 return to the original shapes thereof, the distance L1 can become longer than the distance L2. Therefore, it is possible to prevent the link rotational shafts 128 disengaging from the shaft holes 136.

The link structure 138 can be connected with the back plate 170 and the key top 110. The rotational shaft 134 can be fitted into the rotational support member 112, and the slide shaft 132 can be fitted into the slide support member 152. Also, the slide shaft 122 can be fitted into the slide support member 114, and the rotational shaft 124 can be fitted into the rotational support member 150.

As shown in FIG. 1, after the assembling of the key switch structure 100 is finished, the dome 140 can press the key top 110 in a lifting direction from the membrane sheet 160 under normal conditions. Also, the inside and outside link members 120 and 130 can rotate so as to increase the crossing angle thereof by the pressing force of the dome 140. If the crossing angle approaches the predetermined degree, the stopper surface 180B can contact the stopper surface 182B, and an increase of the crossing angle can be restricted, as shown in FIG. 7B. As a result, it is possible to stabilize the distance from the key top 110 to the membrane sheet 160.

Figure 10:
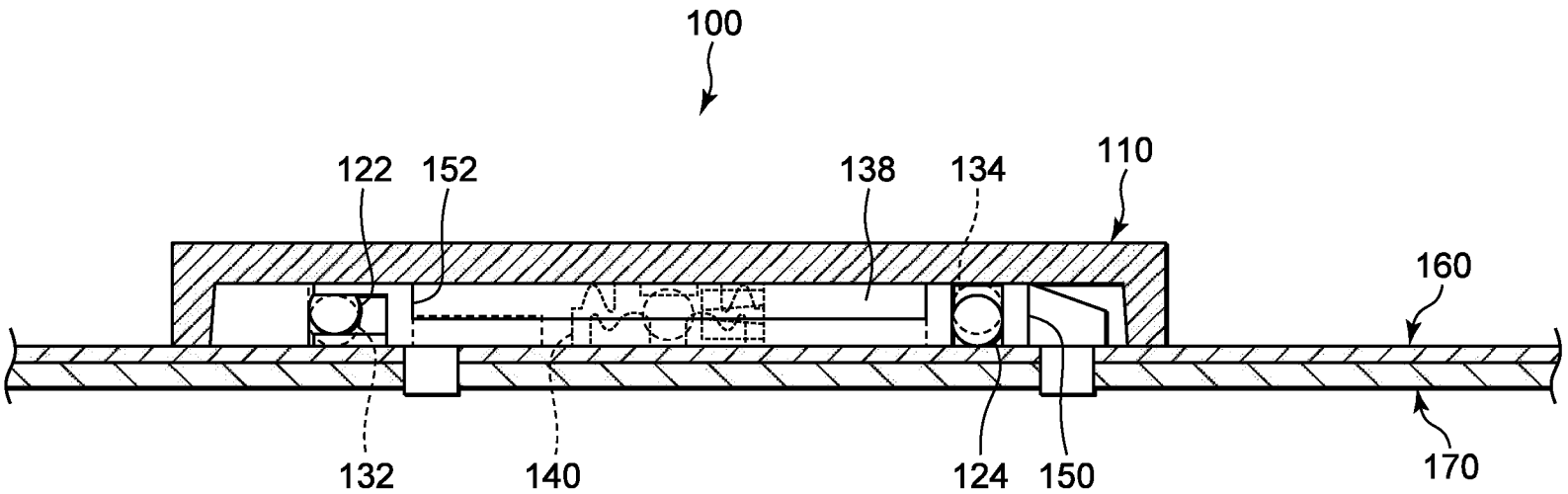
FIG. 10 is a cross-section view illustrating the key switch structure while the key top is in a pressed condition, according to the first embodiment.

As shown in FIG. 10, if the key top 110 is pressed by the operator, the key top 110 can move toward the membrane sheet 160 while keeping parallel to the membrane sheet 160, due to the behavior of the link structure 138, and can deform the dome 140 by the pressure thereof. Also, the contact pressing member 144 can press the contact portion 166 (see FIG. 1, e.g.), and the membrane sheet 160 can be pressed by the contact portion 166. As a result, an electrical connection between the electrical contacts of the upper and under sheets can be formed, and a circuit of the electrical contacts that form an electrical switch can enter or assume a closed condition.

Also, if the operator releases the key top 110 and the key top 110 is released from pressing, the key top 100 can move in the lifting direction from the membrane sheet 160 while keeping parallel to the membrane sheet 160, due to the behavior of the link structure 138. Then, the key top 110 can move until the stopper member 180 contacting the stopper member 182, the key top 110 and the contact pressing member 144 return to the original position. As a result, the electrical connection between the electrical contacts of the upper and under sheets can be released, and a circuit of the electrical contacts that form an electrical switch can enter or assume an opened condition.

As described above, the key switch structure 100 may behave in a satisfactory manner, and may obtain a thin structure.

Next, another variation of the first embodiment of the key switch structure 100 will be described. Elements identical to those of the first embodiment will be designated by the same reference numbers, and results based on inclusion of the identical elements will be incorporated herein by reference.

Figure 11:
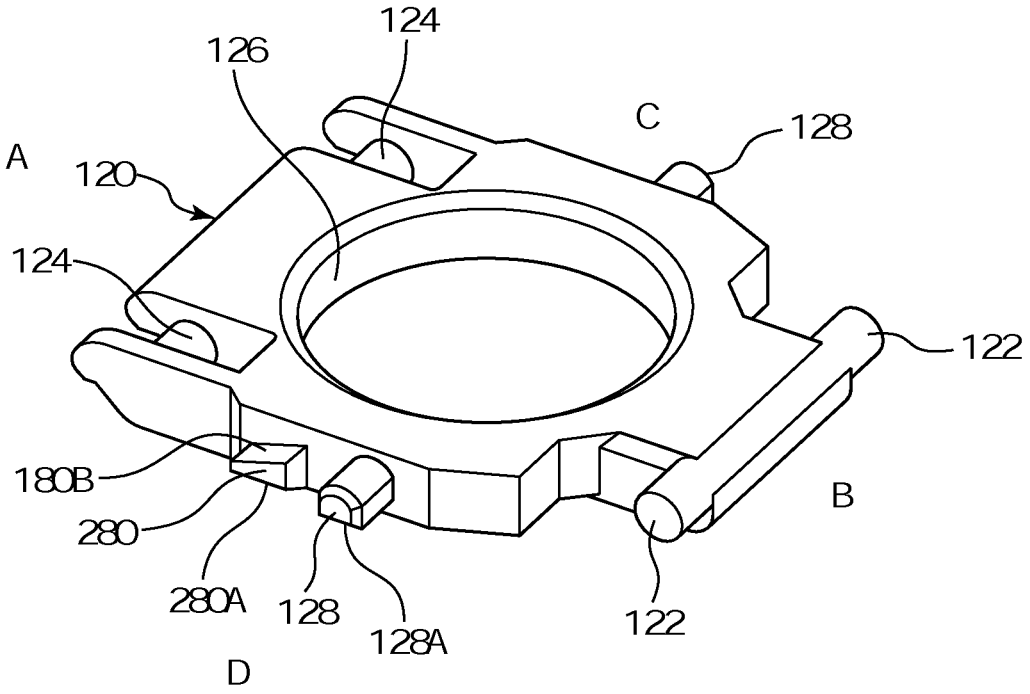
FIG. 11 is a perspective view of the inside link member illustrating a variation of the first embodiment.
Figure 12:
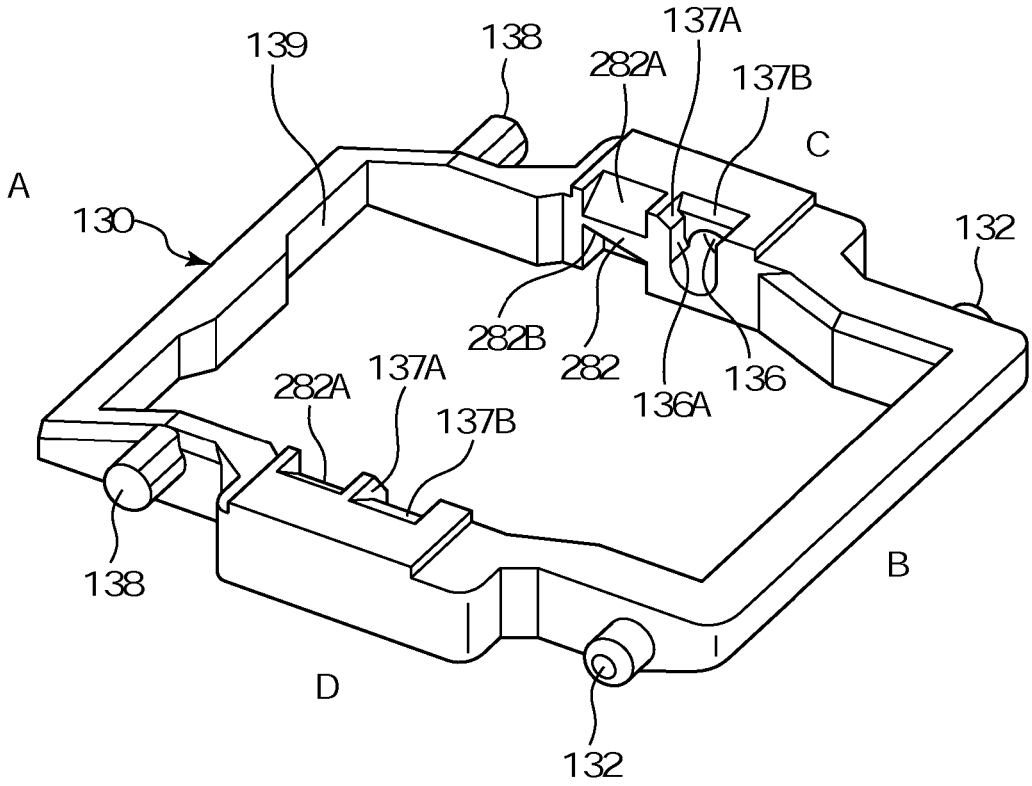
FIG. 12 is a perspective view of the outside link member illustrating another variation of the first embodiment.

FIG. 11 is a perspective view of an inside link member according to the other variation of the first embodiment. FIG. 12 is a perspective view of an outside link member according to the other variation of the first embodiment. As shown in FIGS. 11 and 12, the shape of the inside and outside link members 120 and 130 is slightly different from those of the variation of first embodiment described previously. The inside link member 120 can include stopper members 280 that project outward as compared to the stopper member 180. A stopper 280 member can include an inclined surface 280A and a stopper surface 280B that have the same, or substantially or approximately the same, structure as the inclined surface 180A and the stopper surface 180B. Also, the outside link member 130 can include stopper members 282 at respective inner lateral sides thereof. The distance between the stopper members 282 can be shorter than that of the stopper members 182, e.g., the stopper member 282 can be arranged outside of the outside link member 130, as compared to the stopper member 182, so as to correspond to the stopper member 280 that is disposed outside as compared to the stopper member 180.

In this variation, the outside and inside link members 120 and 130 may be assembled by the same, or substantially or approximately the same, as the procedure of forming the earlier-described variation of the first embodiment. Also, it is possible to obtain the same, or substantially or approximately the same, effect as an effect of the earlier-described variation of the first embodiment. For example, the link rotational shaft 128 may be inserted easily into the shaft hole 136 without unreasonable force applied or added thereto during insertion of the inside link member 120 into the outside link member 130. Also, it is possible to prevent the deformation of link rotational shafts 128 and the shaft holes 136 during that insertion process, and to obtain a key switch structure 100 that may behave in a satisfactory manner. Also, while the key top 110 is at a normal position, e.g., one wherein the operator does not press the key top 110, the stopper 280 can contact the stopper 282, and the distance from the key top 110 to the membrane sheet 160 can be kept steady.

Second Embodiment

Next, a second embodiment will be described. Elements identical to those of the first embodiment will be designated by the same reference numbers, and results based on inclusion of the identical elements will be incorporated herein by reference.

Figure 13:
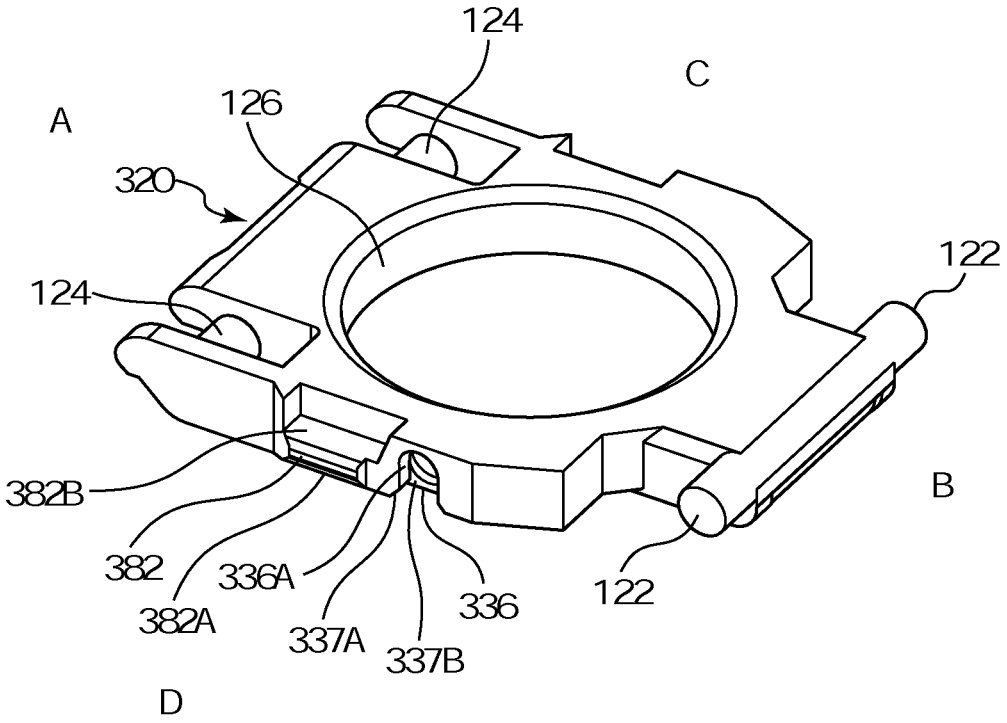
FIG. 13 is a perspective view of an inside link member according to a second embodiment.
Figure 14:
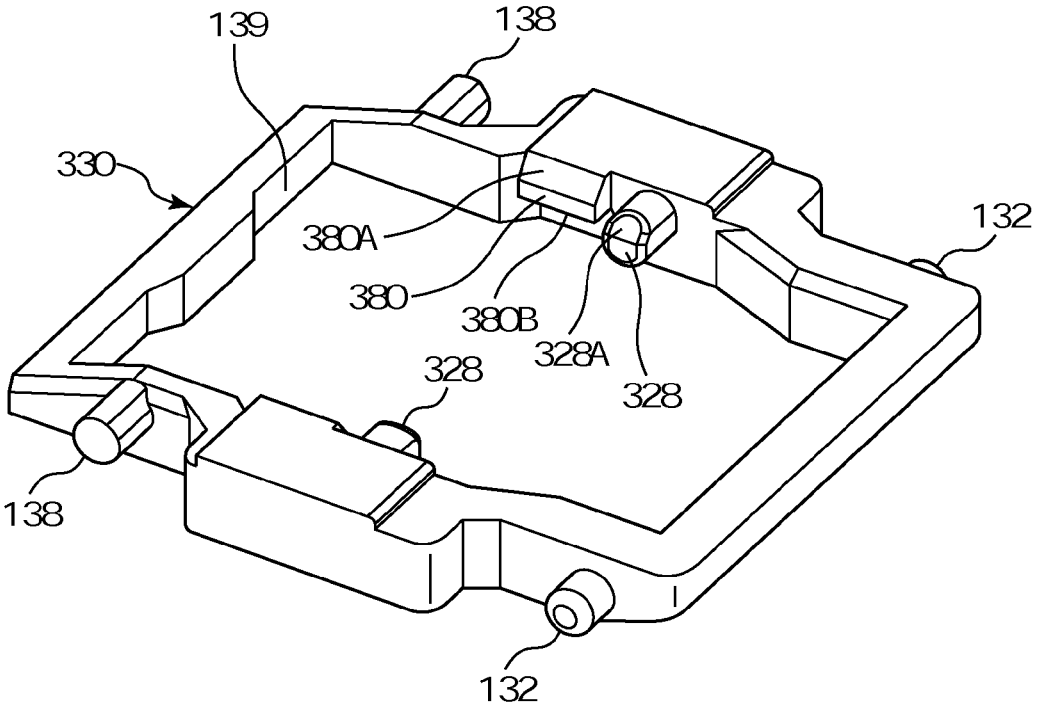
FIG. 14 is a perspective view of an outside link member according to the second embodiment.

FIG. 13 is a perspective view of an inside link member according to the second embodiment. FIG. 14 is a perspective view of an outside link member according to the second embodiment. As shown in FIGS. 13 and 14, the shape of the inside and outside link members 320 and 330 can be different from those of the first embodiment.

The inside link member 320 can have two shaft holes 336 formed therein, and can include two stopper members 382 instead of the link rotational shafts 128 and the stopper members 180. The shaft hole 336 can have an inserting groove 336A formed on a surface thereof, and include two chamfered portions 337A and 337B. The shaft hole 336, the stopper member 382, the inserting groove 336A, and the chamfered portion 337B can have respectively the same, or approximately or substantially the same, function as the shaft hole 136, the stopper member 182, the inserting groove 136A, and the chamfered portion 137B described earlier. The stopper member 382 can include an inclined surface 382A and a stopper surface 382B. The stopper member 382, the inclined surface 382A, and the stopper surface 382B can have respectively the same, or approximately or substantially the same, function of the stopper member 182, the inclined surface 182A, and the stopper surface 182B described earlier.

The outside link member 330 can include two link rotational shafts 328, and two stopper members 380 instead of the shaft holes 136 and the stopper member 182. The link rotational shaft 328 can include an inclined surface 328A. The link rotational shaft 328, and the inclined surface 328A can have respectively the same, or approximately or substantially the same, structure of the link rotational shaft 128, and the inclined surface 128A. The stopper member 380 can include an inclined surface 380A, and a stopper surface 380B. The stopper member 380, the inclined surface 380A, and the stopper surface 380B have respectively the same, or approximately or substantially the same, function as those of the stopper member 180, the inclined surface 180A, and the stopper surface 180B.

In the second embodiment, the outside and inside link members 320 and 330 may be assembled by the same, or approximately or substantially the same, procedure as the assembly procedure of the first embodiment. Also, it is possible to obtain the same, or approximately or substantially the same, effect as an effect of the first embodiment. For example, the link rotational shaft 328 may be inserted easily into the shaft hole 336 without unreasonable force added or applied thereto during insertion of the inside link member 320 into the outside link member 330. Also, it is possible to prevent deformation of link rotational shafts 328 and the shaft holes 133 during that insertion process, and to obtain a key switch structure 100 that may behave in a satisfactory manner. Also, while the key top 110 is at a normal position, e.g., one wherein the operator does not press the key top 110, the stopper 380 can contact the stopper 382, and the distance from the key top 110 to the membrane sheet 160 can be kept steady.

The embodiments are not limited to those described above. According to the described embodiments, the link structure and the key switch structure relates to the keyboard. However, the link structure may be used for other apparatuses that include the link structure.

What has been described above includes examples of embodiments represented by the appended claims. It is, of course, not possible to describe every conceivable combination of components or methodologies encompassed by the claims, but it should be understood that many further combinations and permutations are possible. Accordingly, the claims are intended to embrace all such combinations, permutations, alterations, modifications and variations that fall within the spirit and scope of the claims. Moreover, the above description, and the Abstract, are not intended to be exhaustive or to limit the spirit and scope of the claims to the precise forms disclosed.

What is claimed is:

1. A link structure, comprising:

an outside link member including a first opening portion having inner lateral sides, wherein shaft holes are formed in respective ones of the inner lateral sides and face each other across the first opening portion, and first stopper members arranged on the respective ones of the inner lateral sides and facing each other across the first opening portion, each first stopper member having a side with a first inclined surface inclining toward the first opening portion and thinning down the first stopper member toward the first opening portion, and a first stopper surface on another side of the first stopper member, wherein the outside link member is elastically deformable based on a pressure applied to the first inclined surfaces that increases a distance between the shaft holes and between the first stopper members; and an inside link member including a second opening portion having outer lateral sides, link rotational shafts disposed in the shaft holes, the link rotational shafts arranged on respective ones of the outer lateral sides of the inside link member and opposite each other across the second opening portion, and second stopper members, each second stopper member having a side with a second inclined surface inclining toward the outside of the inside link member and thinning down the second stopper member toward the outside of the inside link member, and a second stopper surface on another side of the second stopper member, the second stopper members arranged on the respective ones of the outer lateral sides and opposite each other across the second opening portion, wherein the inside link member is elastically deformable based on a pressure applied to the second inclined surfaces that decreases a distance between the second inclined surfaces and between the link rotational shafts;

wherein the inside and outside link members are able to rotate against each other, and the first and second stopper surfaces face each other.

2. A key switch structure that includes the link structure of claim 1, and further comprising:

a key top that supports one end of the outside link member, and one end of the inside link member, the one end of the outside link member and the one end of the inside link member being parallel to a rotational axis of the link structure;

a back plate that slidably supports another end of the outside link member;

a membrane sheet arranged on the back plate and facing toward the key top, and including a contacting portion arranged on a surface of the membrane sheet and connectable, in response to a predetermined pressure, to an electrical contact to form at least one closed circuit; and an elastic member arranged between the key top and the membrane sheet that presses and separates the key top from the back plate, increases an angle between the outside link member and the inside link member, and is elastically deformable to transmit the predetermined pressure to the contacting portion.

3. The key switch structure of claim 2, wherein an increase of in the angle between the outside link member and in the inside link member is restricted by contact of the first and second stopper surfaces, and a distance from the key top to the back plate is determined by the angle.

4. A link structure, comprising:

an outside link member including a first opening portion having inner lateral sides, link rotational shafts arranged on respective ones of the inner lateral sides and facing each other across the first opening portion, and a first stopper member arranged on the respective ones of the inner lateral sides and facing each other across the first opening portion, each first stopper member having a side with a first inclined surface inclining toward the first opening portion and thinning down the first stopper member toward the first opening portion, and a first stopper surface on another side of the first stopper member, wherein the outside link member is elastically deformable based on a pressure applied to the first inclined surfaces that increases a distance between the link rotational shafts and between the first stopper members; and an inside link member including a second opening portion having outer lateral sides, wherein shaft holes are formed in respective ones of the outer lateral sides, and the link rotational shafts are disposed in the shaft holes, and second stopper members, each second stopper member having a side with a second inclined surface inclining toward an outside of the inside link member and thinning down the second stopper member toward the outside of the inside link member, and a second stopper surface on another side of the second stopper member, the second stopper members arranged on the respective ones of the outer lateral sides and opposite each other across the second opening portion, wherein the inside link member is elastically deformable based on a pressure applied to the second inclined surfaces that decreases a distance between the second inclined surfaces and between the shaft holes;

wherein the inside and outside link members are able to rotate against each other, and the first and second stopper surfaces face each other.

* * * * *